US008997926B2

(12) United States Patent
O'Reilly et al.

(10) Patent No.: US 8,997,926 B2
(45) Date of Patent: Apr. 7, 2015

(54) SCAFFOLD FALL PROTECTION SYSTEM

(75) Inventors: Robert O'Reilly, Brewster, NY (US); Chris John Chetti, Ronkonkoma, NY (US)

(73) Assignee: Robert O'Reilly, Brewster, NY (US)

( * ) Notice: Subject to any disclaimer, the term of this patent is extended or adjusted under 35 U.S.C. 154(b) by 309 days.

(21) Appl. No.: 13/279,705

(22) Filed: Oct. 24, 2011

(65) Prior Publication Data

US 2012/0298444 A1 Nov. 29, 2012

Related U.S. Application Data

(60) Provisional application No. 61/490,857, filed on May 27, 2011.

(51) Int. Cl.

| | |
|---|---|
| ***A62B 35/00*** | (2006.01) |
| ***E04G 5/00*** | (2006.01) |
| ***E04G 5/10*** | (2006.01) |

(52) U.S. Cl.

CPC ..... *A62B 35/0056* (2013.01); *E04G 5/001* (2013.01); *E04G 5/10* (2013.01)

(58) Field of Classification Search

CPC ..... E04G 5/14
USPC ..... 182/3, 9, 36
See application file for complete search history.

(56) References Cited

U.S. PATENT DOCUMENTS

| | | | | |
|---|---|---|---|---|
| 3,933,220 | A * | 1/1976 | Swager | 182/3 |
| 4,037,824 | A * | 7/1977 | Whitmer | 256/53 |
| 4,499,966 | A * | 2/1985 | Milne et al. | 182/3 |
| 5,156,233 | A * | 10/1992 | Olsen et al. | 182/3 |
| 6,148,580 | A * | 11/2000 | Weir | 52/651.1 |
| 6,776,259 | B1 * | 8/2004 | Murten | 182/3 |
| 6,779,630 | B2 * | 8/2004 | Choate | 182/36 |
| 7,637,351 | B2 * | 12/2009 | Langsmead | 182/113 |
| 8,100,227 | B2 * | 1/2012 | Southworth | 182/130 |
| 2001/0027897 | A1 * | 10/2001 | Olson et al. | 182/45 |
| 2001/0032435 | A1 * | 10/2001 | Austin | 52/749.12 |
| 2005/0098381 | A1 * | 5/2005 | Flaherty | 182/3 |
| 2005/0284693 | A1 * | 12/2005 | Rhodes | 182/3 |
| 2009/0020363 | A1 * | 1/2009 | Ingalls | 182/113 |
| 2010/0025151 | A1 * | 2/2010 | Guinart Pallares | 182/112 |
| 2010/0096214 | A1 * | 4/2010 | Langsmead | 182/3 |
| 2011/0226548 | A1 * | 9/2011 | Witlam et al. | 182/3 |
| 2011/0315474 | A1 * | 12/2011 | Wiser | 182/3 |
| 2012/0138386 | A1 * | 6/2012 | Robitaille | 182/3 |

FOREIGN PATENT DOCUMENTS

| | | | | |
|---|---|---|---|---|
| GB | 2324328 | A * | 10/1998 | E04G 7/28 |
| JP | 06047104 | A * | 2/1994 | A62B 35/00 |
| JP | 06098945 | A * | 4/1994 | A62B 35/00 |

* cited by examiner

*Primary Examiner* — Charles A Fox
*Assistant Examiner* — Kristine Florio
(74) *Attorney, Agent, or Firm* — Law Firm of Ursula B. Day; Ursula B. Day

(57) ABSTRACT

The present invention relates to fall protection systems to which a scaffolder can tie off during scaffold construction by adjusting the height of the lifeline and to move along the entire length of a scaffold level without having to disengage the lifeline. In one embodiment the fall protection system includes two vertical support members adapted to be affixed to a scaffold frame wherein the two vertical members have attachment means for attachment of a lifeline, and wherein the attachment means are located at each respective vertical member and configured for movable attachment at a plurality of positions along the vertical axis of each support members. In addition the present invention relates to methods to use the fall protection system during scaffold construction.

12 Claims, 23 Drawing Sheets

SCAFFOLD FALL PROTECTION SYSTEM

CROSS-REFERENCES TO RELATED APPLICATIONS

This application claims the priority of provisional patent application Appl. No. 61/490,857, filed May 27, 2011.

BACKGROUND OF THE INVENTION

The present invention relates to the field of scaffolding safety and in particular scaffold safety relating to fall protection systems.

Many types of construction or maintenance of buildings, have to be carried out at relatively high elevations and thus require the use of scaffolds. An inherent risk during this type of work is falling from the scaffold during erection of the scaffold or during working on the scaffold. Often, the distance from the fall site to the ground is relatively large and the fall can thus cause severe injury or death. Various devices are currently used to prevent a person working on a scaffold to fall off the scaffold. Examples of safety devices currently used for fall protection during scaffolding are retractable lanyards or safety straps with rope grab mechanism. In both cases, the lanyard or safety strap is attached to a harness worn by the scaffolder. The lanyard or safety strap is then secured on the scaffold frame. There are several disadvantages to these devices. First, due to regulations, the lanyard or safety strap cannot exceed several feet in length. Thus a worker might have to release and re-attach his lanyard or safety strap several times when walking from one end of the scaffold to the other. This presents an inconvenience to workers and prevents them from walking efficiently and freely on the scaffold. Especially when work on the scaffold requires using both hands to carry building material etc. releasing and re-attaching the lanyard or safety strap will interfere with the construction process. Further, when erecting a new level of scaffolding, the initial platform of the newly built level does not provide any tie off points above the waist level of the worker. Workers therefore have to remain tied off on the first level below. This means that the lanyard or safety strap will extend below the waist of the worker and presents the risk of tripping over the lanyard or safety strap or getting caught up on the scaffold frames below. Having the lanyard secured below the waist level of the worker also means that in case of a fall, the fall distance equals almost the entire length of the lanyard and poses the risk of injury.

It would therefore be desirable and advantageous to provide an improved fall protection system to obviate prior shortcomings of other systems to provide a system that is safer and more convenient for workers during scaffold construction.

SUMMARY OF THE INVENTION

In one aspect of the present invention, the fall protection system includes a first longitudinal vertical support member and a second longitudinal vertical support member, adapted to be affixed to a scaffold frame, and a lifeline extending between the first and second longitudinal vertical member.

It is another aspect of the present invention to include more than one fall protection system being installed at the same time. If more than one protection system is installed the second fall protection system is to be installed in such a way that the second lifeline is located on the opposite site of the first lifeline, thus allowing two workers to tie off on different lifelines and to cross paths without their tie off rings interfering with each other.

In another aspect of the present invention, the lifeline can be made from different materials like textile or metal. Preferably the lifeline is made out of high tensile material such as nylon or polyester rope but may also be made out of steel or wire rope. In a particularly preferred embodiment the lifeline is pre-engineered and includes cable attachments (e.g. cable clamps, hooks, loops or carabiners) to secure the ends of the lifeline to the vertical support members and further includes devices to tighten the lifeline (e.g. a come along or a winch).

In another aspect of the present invention the fall protection system includes a first longitudinal vertical support member and a second longitudinal vertical support member adapted to be affixed to a scaffold frame, a lifeline extending between the first and second longitudinal vertical member, attachment means for the attachment of the lifeline, with the attachment means being located at each respective vertical member. The attachment means can be affixed at a chosen position along the vertical axis of each vertical support member and if desired, released and reaffixed at a different position along the vertical axes of each vertical support member.

In another aspect of the present invention each of the vertical support members is provided with grooves extending along the vertical axis of each support member and the attachment means are constructed to be movably attachable in the grooves.

It is a further aspect of the present invention for the fall protection system to include a first longitudinal vertical support member and a second longitudinal vertical support member adapted to be affixed to a scaffold frame, a lifeline extending between said first and second longitudinal vertical member, and attachment means for the attachment of said lifeline. The attachment means are located at each respective vertical support member. The attachment means can be affixed at a chosen position along the vertical axis of each vertical support member and if desired, released and reaffixed at a different position along the vertical axis of each vertical support member. Further, each of the vertical support members is provided with grooves extending along the vertical axis of each support member and the attachment means are constructed as T-plates for movable attachment in the grooves.

Advantageously, the fall protection system includes a first square longitudinal vertical support member and a second square longitudinal vertical support member, adapted for being affixed to a scaffold frame, a lifeline extending between the first and second square longitudinal vertical members and attachment means for the attachment of the lifeline. The attachment means are located at each respective vertical member and are adapted to be affixed at a chosen position along the vertical axes of the vertical support members. If desired the attachment means can be released and reaffixed at a different position along the vertical axis of the vertical support members. Further, the attachment means have a portion adapted for affixing the lifeline.

Furthermore, the fall protection system includes a first circular longitudinal vertical support member and a second circular longitudinal vertical support member, adapted to be affixed to a scaffold frame, a lifeline extending between the first and second square longitudinal vertical member and attachment means for the attachment of the lifeline. The attachment means are located at each respective vertical member and can be affixed at a chosen position along the vertical axis of each vertical support member. If desired, the attachment means can be released and reaffixed at a different position along the vertical axis of the vertical support member. Further, the attachment means have a portion adapted for affixing the lifeline.

It is a further aspect of the present invention for the fall protection system to include a first hexagonal longitudinal vertical support member and a second hexagonal longitudinal vertical support member, adapted to being affixed to a scaffold frame, a lifeline extending between the first and second hexagonal longitudinal vertical member and attachment means for the attachment of the lifeline. The attachment means are located at each respective vertical member and are adapted to be affixed at a chosen position along the vertical axes of the vertical support members. If desired the attachment means can be released and reaffixed at a different position along the vertical axis of the vertical support members. Further, the attachment means have a portion adapted for affixing the lifeline.

In a further aspect of the present invention the vertical support members are made from metal, an alloy, plastic, or a combination thereof or any type of material that has the strength to withstand the force of an accidental fall of a person using the system. Examples of such materials include steel, titanium, or a combination thereof.

In another embodiment, the fall protection system further includes a ladder adapted to be affixed to the vertical support member and to aid in moving between scaffold levels.

It is a further aspect of the present invention for the fall protection system to include a rope grab mechanism attached to the vertical support members.

It is another aspect of the present invention that the fall protection system further includes a deflector post adapted to guide the horizontal lifeline around a corner.

The present invention also relates to a method of using the fall protection system in which the fall protection system includes a first longitudinal vertical support member and a second longitudinal vertical support member, adapted to be affixed to a scaffold frame, a first lifeline and a second lifeline, attachment means for attachment of the lifelines, the attachment means being located at each respective vertical support member and configured for movable attachment at a plurality of positions along a vertical axis of the first and second vertical support members. The method includes the steps of attaching the first and second vertical support member to a scaffold structure, attaching the first lifeline to the attachment means on either of the vertical support members, tethering a person to the first lifeline during construction of a scaffold level, extending the second lifeline across the top of the new completed scaffold level, attaching the second lifeline to the attachment means on either of the vertical support members, tethering the person to the second lifeline, detaching the vertical members from the scaffold structure, reattaching the vertical members at a higher height at the scaffold structure, untethering the person from the first lifeline, detaching the first lifeline from the attachment means, adjusting the attachment means to a higher position along the vertical axis of each of the vertical member.

The present invention resolves prior art problems by providing a fall protection system that enables the scaffold erectors to remain tied off during the entire phase of scaffold construction and dismantling. It provides tie off sites that are height adjustable at newly formed scaffold levels and allow workers on a scaffold to walk freely along the entire length of a scaffold platform without having to move their lanyard or safety strap. The system also includes a ladder that allows employees to climb from one scaffold level to the next instead of having to climb on the scaffold frame.

BRIEF DESCRIPTION OF THE DRAWINGS

Other features and advantages of the present invention will be more readily apparent upon reading the following description of currently preferred exemplified embodiments of the invention with reference to the accompanying drawing, in which.

DETAILED DESCRIPTION OF THE PREFERRED EMBODIMENTS

Figure 1A:
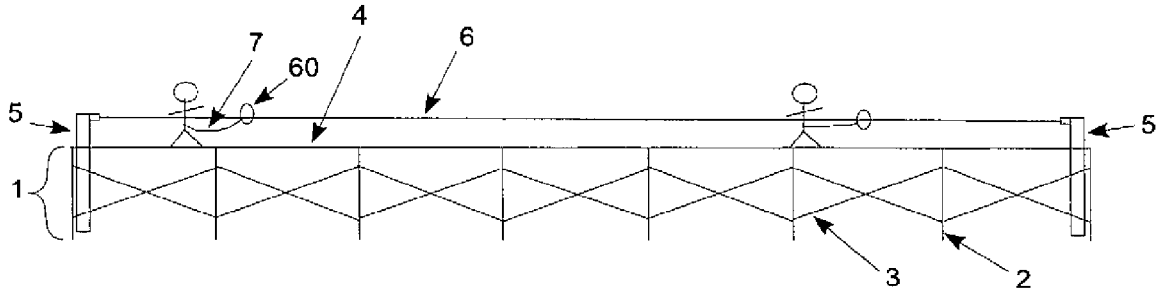
FIG. 1A is an elevational front view of an erected scaffold showing the fall protection system support members at each end of the scaffold.

Throughout all the Figures, same or corresponding elements are generally indicated by same reference numerals.

Turning now to the drawing and in particular to FIG. 1A, there is shown an elevational front view of an embodiment of the basic use and setup of the fall protection system comprising vertical support members 5 and lifeline 6 mounted on a scaffold structure 1. The scaffold structure 1 has scaffold frames 2 and scaffold braces 3 supporting a platform 4. A vertical support member 5 is affixed to either end of the scaffold structure 1 with a lifeline 6 extending between each of the vertical support members 5. As FIG. 1A illustrates, a person present on the platform 4 of the scaffold can tie off to the lifeline 6 with a safety strap 7 connected to a tie off ring 60.

Figure 1B:
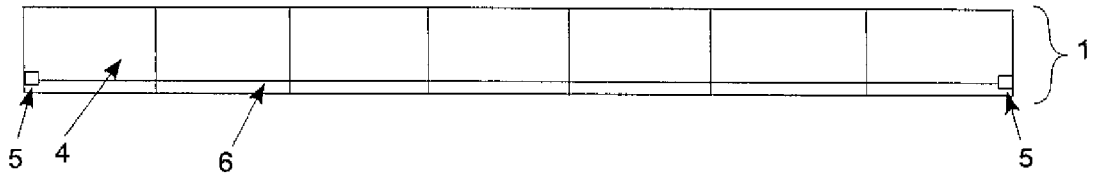
FIG. 1B is a top plan view of the scaffold with the fall protection system in place.

In FIG. 1B a vertical support member 5 is shown on either side of the scaffold structure 1 and the lifeline 6 extending between each of them. In a preferred embodiment each of the vertical support members 5 is set up in such a way that the lifeline 6 extending between each vertical support member 5 is located on one side of the scaffold platform 4 in order to allow for easy maneuvering of workers on the platform.

Figure 2A:
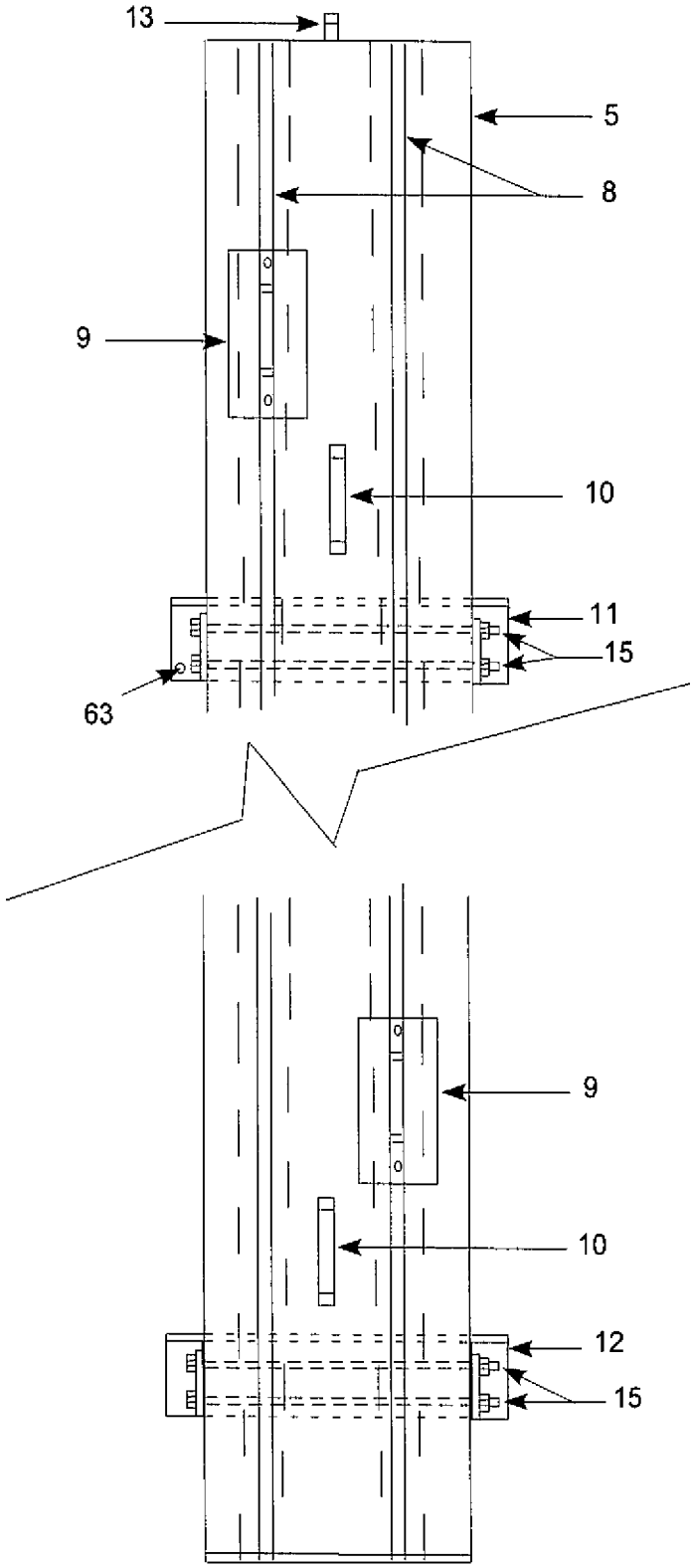
FIG. 2A is an elevational front view of a T-plate and groove version of a vertical support member.
Figure 2B:
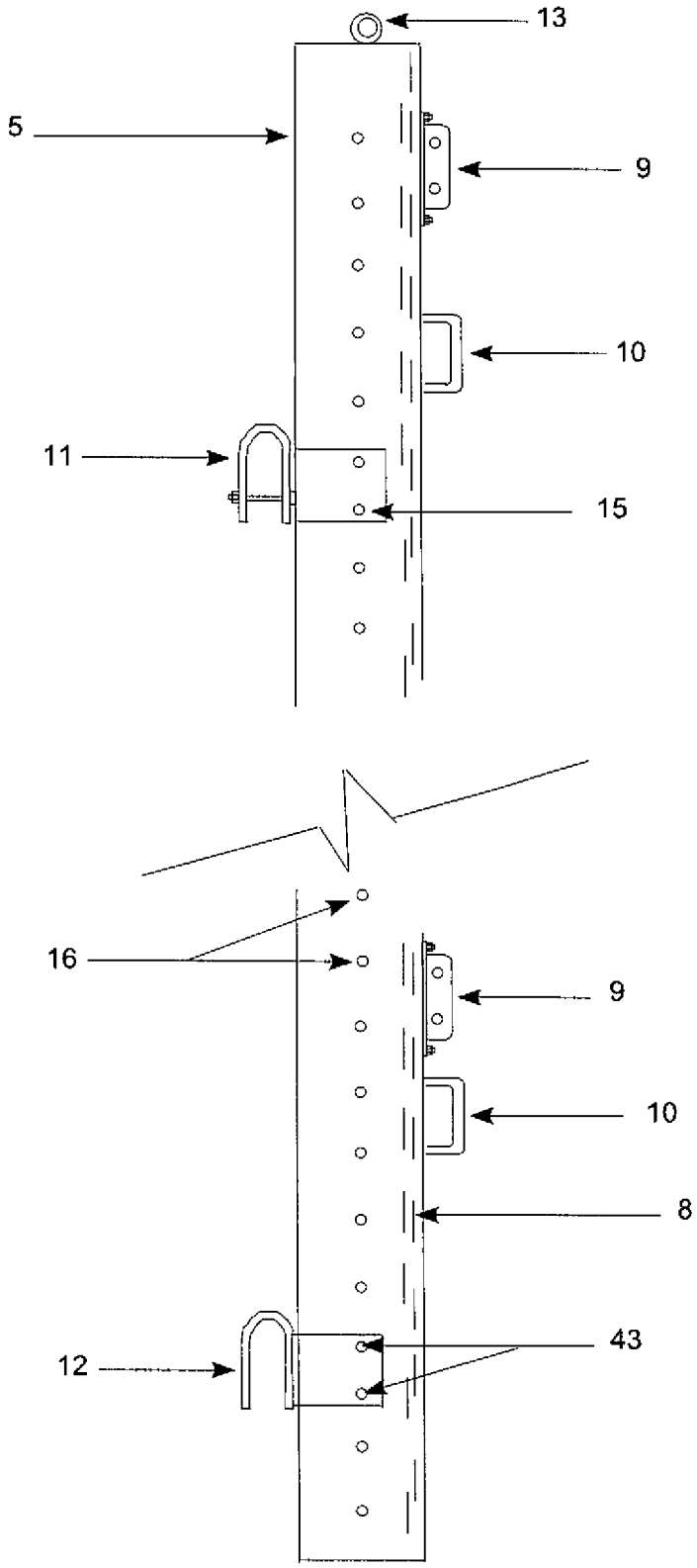
FIG. 2B is an elevational side view of a T-plate and groove version of a vertical support member.
Figure 2C:
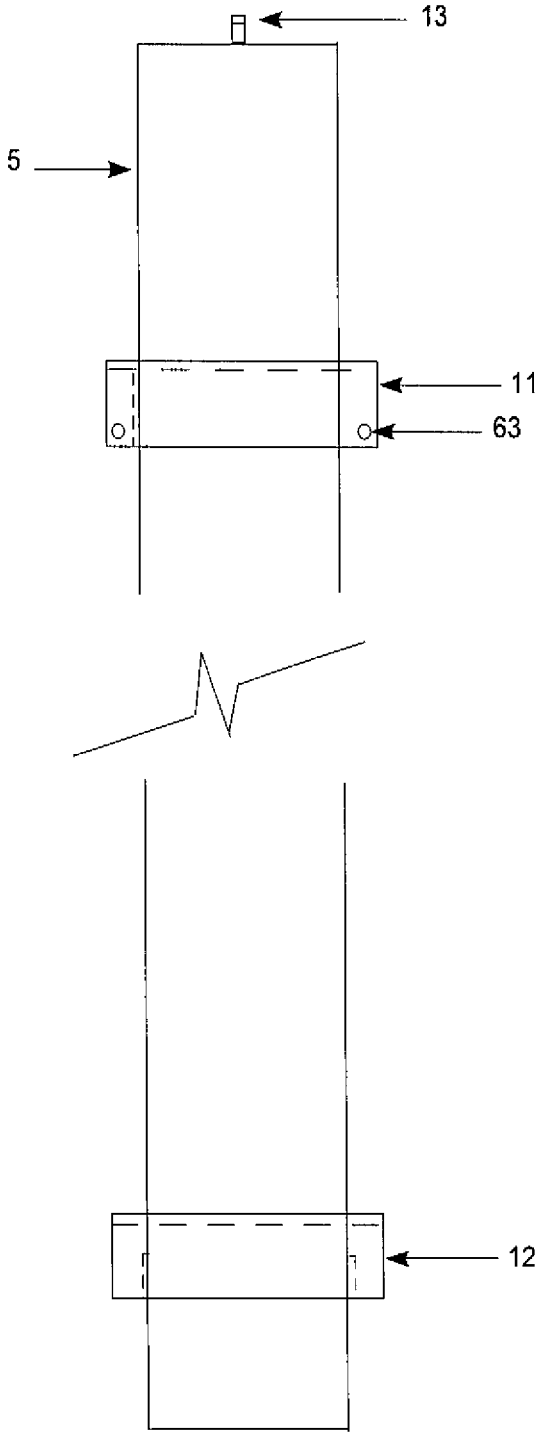
FIG. 2C is an elevational rear view of a T-plate and groove version of a vertical support member.

FIGS. 2A-C show each vertical support member 5 having T-shaped grooves 8 in which each T-plate 9 is movable up or down along the vertical axis of each vertical support member 5. T-plate 9 is configured for attachment of the lifeline (not shown here) to the T-plate 9. The height of the lifeline is adjustable by moving each T-plate 9 vertically up or down along the T-shaped grooves 8, to accommodate scaffold erectors' needs. Top U-bracket 11 and bottom U-bracket 12 are attachments for securing each vertical support member 5 to the scaffold. Top U-bracket 11 and bottom U-bracket 12 are attached to each vertical support member 5 by thru bolts 15 that pass through U-bracket attachment holes 43 of the respective top U-bracket 11 and bottom U-bracket 12 and lateral holes 16 in each vertical support member 5. The top U-bracket is secured to the scaffold frame by inserting bolts or pins into holes 17 to prevent disengagement of the vertical support member 5 from the scaffold frame through accidental upward movement. The vertical position of the bottom U-bracket 12 on each vertical support member 5 is adjustable to accommodate different size scaffold frames. Other examples of attachments that can be used to secure the vertical support members 5 to the scaffold include clamps, clasps, vises, nut & bolt arrangements, fasteners, grips, or quick-release snap clamps or any other suitable attachments. Any attachment can be used so long as the vertical support members are securely attached to the scaffold and the vertical position of at least one of the attachments on each vertical support member 5 can be adjusted to accommodate different size scaffold frames 1. A handle 10 may be present on each vertical support member 5 to aid in lifting and moving the vertical support member 5 to the desired position on the scaffold. Although the handle 10 shown in FIG. 2A is D-shaped other shapes of handles or devices can be used such as knobs as long as they aid in lifting and moving the vertical support member 5 to the desired position on the scaffold. The tie off eye 13 on top of the vertical support member 5 is used to tether the vertical support member to the scaffold frame while moving the vertical support member 5 from one position on the scaffold frame to another position. The lateral holes 16 are also used to bolt a ladder (ladder not shown here) to the vertical support member 5.

Figure 3A:
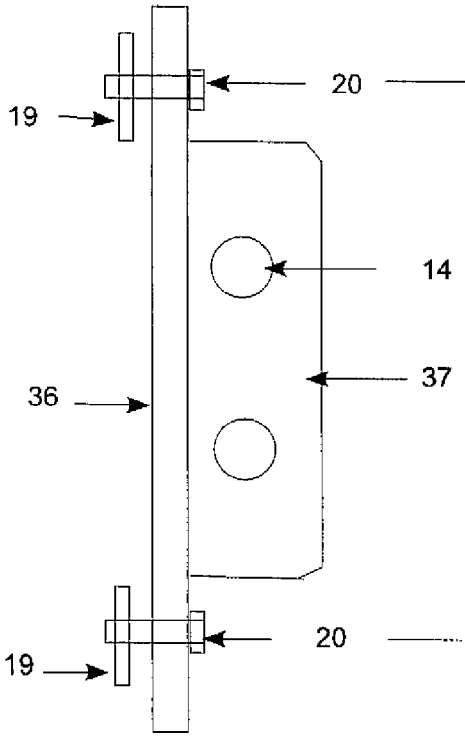
FIG. 3A is an elevational side view of a T-plate used in the T-plate and groove version of the system.
Figure 3B:
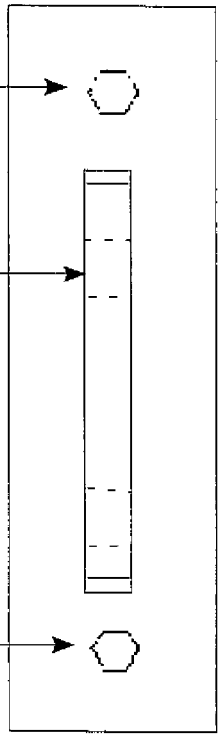
FIG. 3B is an elevational side view of a T-plate used in the T-plate and groove version of the system.
Figure 3C:
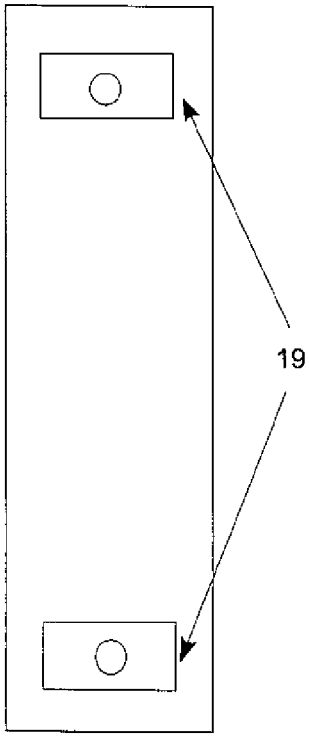
FIG. 3C is an elevational side view of a T-plate used in the T-plate and groove version of the system.
Figure 3D:
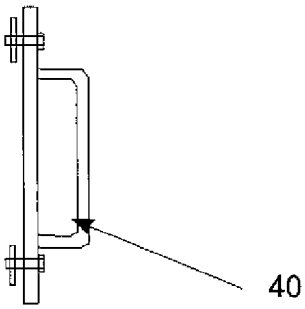
FIG. 3D is an elevational side view of a D-handle used in the T-plate and groove version of the system.

FIGS. 3A-D show an example of a T-plate 9 as used in the T-plate and groove version of the fall protection system. The T-plate 9 has a face plate 36 and a tongue 37. The T-plate 9 is locked at a desired elevation with bolts 20 that extend through the face plate 36 and engage with a threaded block 19 that fits into the T-shaped groove 8 on each vertical support member 5. Further, FIG. 3A shows circular holes 14 in the tongue 37 to attach a lifeline (lifeline not shown). While FIG. 3A shows two circular holes 14 for the attachment of a lifeline, the number and shape of these holes 14 may vary. For example, as shown in FIG. 3D the tongue portion 37 can take on the shape of a D-handle 40. The tongue portion 37 may have any shape or configuration so long as it allows for attachment of a lifeline. Further, instead of the bolts 20 and threaded blocks 19 other devices can be used as long as they allow a T-plate 9 to be movably attached in a T-shaped groove 8 and securely locked at a desired position along the vertical axis of each vertical support member 5.

Figure 4:
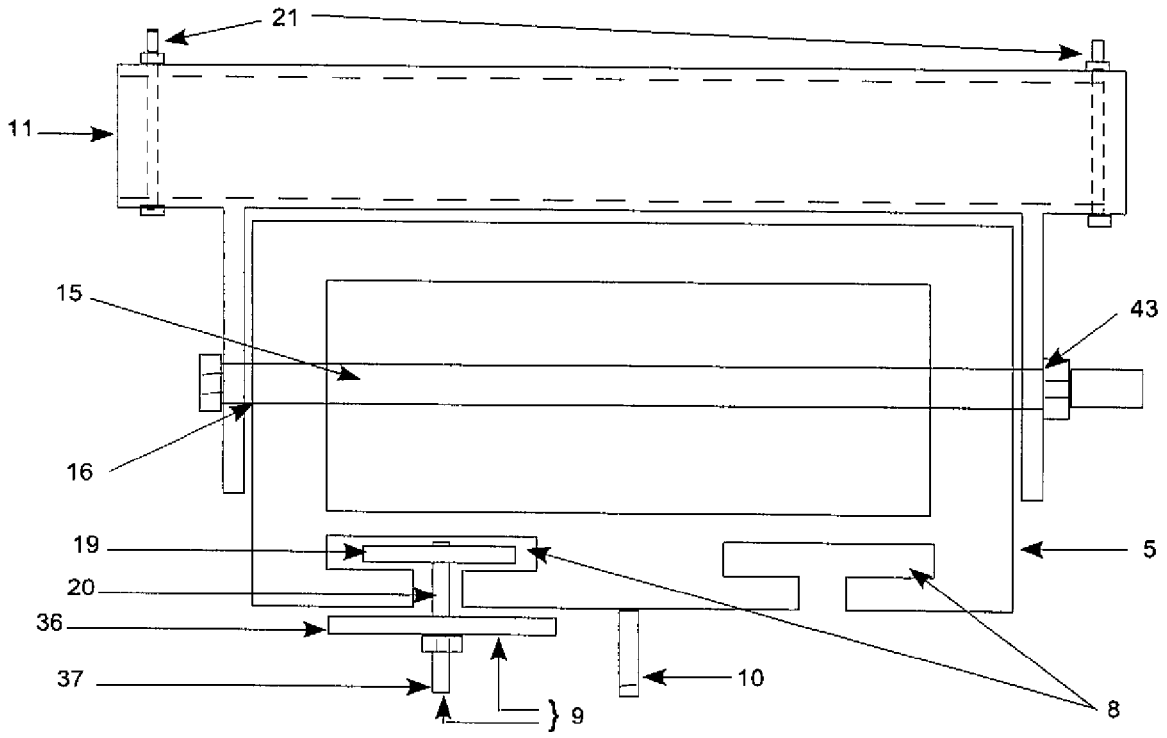
FIG. 4 is a plan view of the rail system used in the T-plate and groove version of the system.

FIG. 4 shows the T-shaped grooves 8 in more detail. The vertical support member 5 has one or more T-shaped grooves 8 that accommodate the threaded block 19 of a T-plate 9. FIG. 4 illustrates that the top U-bracket 11 is locked to the vertical support member 5 with a bolt 15 that passes through the U-bracket attachment holes 43 and lateral holes 16 of the vertical support member 5. The T-plate 9 is movable up and down along the vertical axis of the vertical support member 5 and remains attached to the vertical support member 5 by its connection to the threaded block 19 in the T-shaped grooves 8. The T-shaped grooves 8 are closed on their bottom, preventing the T-plate 9 from falling out.

Figure 5A:
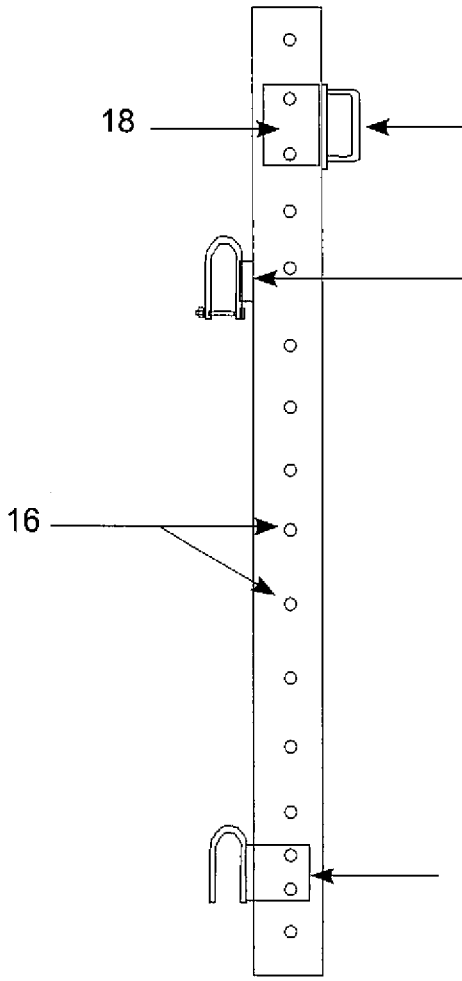
FIG. 5A is an elevational side view of the square version of a vertical support member.
Figure 5B:
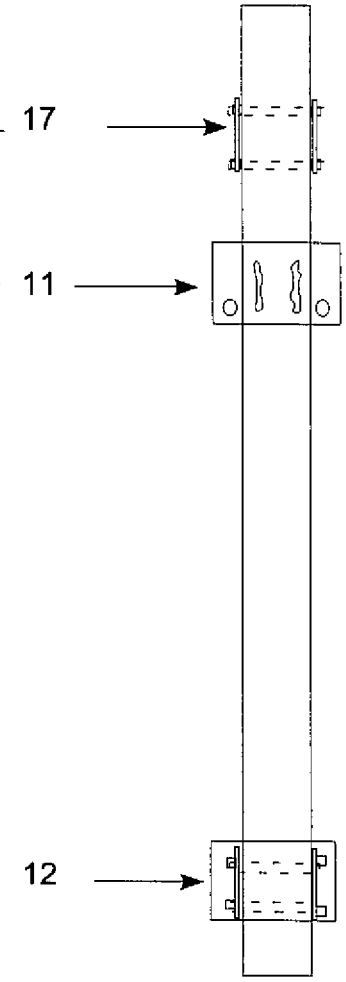
FIG. 5B is an elevational rear view of the square version of a vertical support member.
Figure 5C:
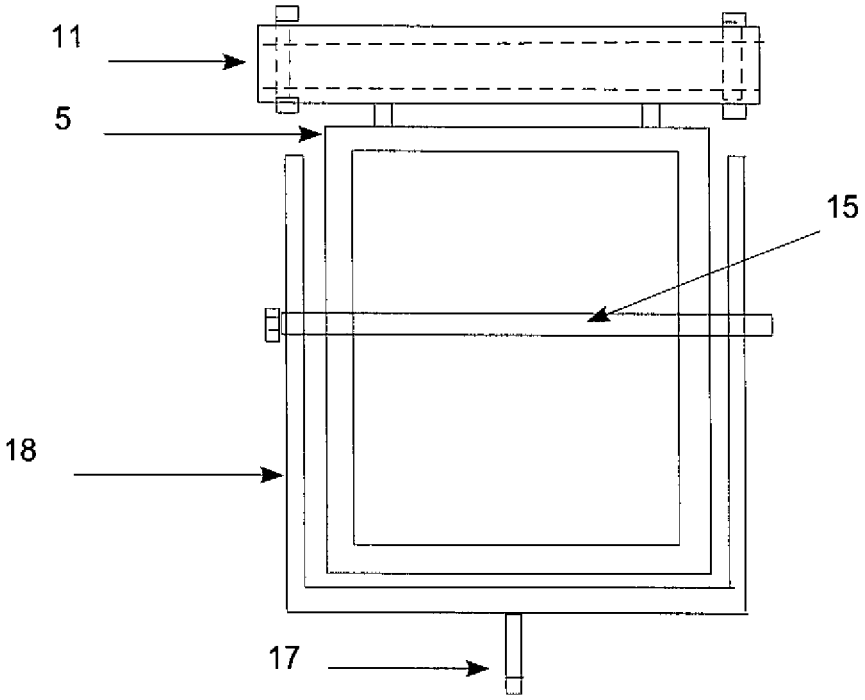
FIG. 5C is an elevational plan view of the square version of a vertical support member.

FIGS. 5A-C show an embodiment of the square version of the fall protection system. In this embodiment the movable attachment means is a sliding collar 18 with tie off handle 17. The top U-bracket 11 in this embodiment is fixed to the rear of the vertical support member 5 to allow the sliding collar 18 with tie off handle 17 to pass freely along the vertical support member 5. The vertical position of the bottom U-bracket 12 along the vertical support member is adjustable to accommodate different size scaffold frames. To secure the bottom U-bracket 12 at a chosen vertical position on the vertical support member 5 the bottom U-bracket 12 is bolted in place using to the lateral holes 16. More than one sliding collar 18 may be present on the vertical support member 5 allowing for more than one lifeline to be attached and workers to tie off on independent lifelines. FIG. 5C shows in more detail the arrangement of the sliding collar 18 relative to the vertical support member 5. The sliding collar 18 is movable to a desired position along the vertical support member 5 and is then fixed in place with a pin or bolt 19 that extends through holes (not shown) in the sliding collar 18 and the lateral holes 16 in the vertical support member 5.

Figure 6A:
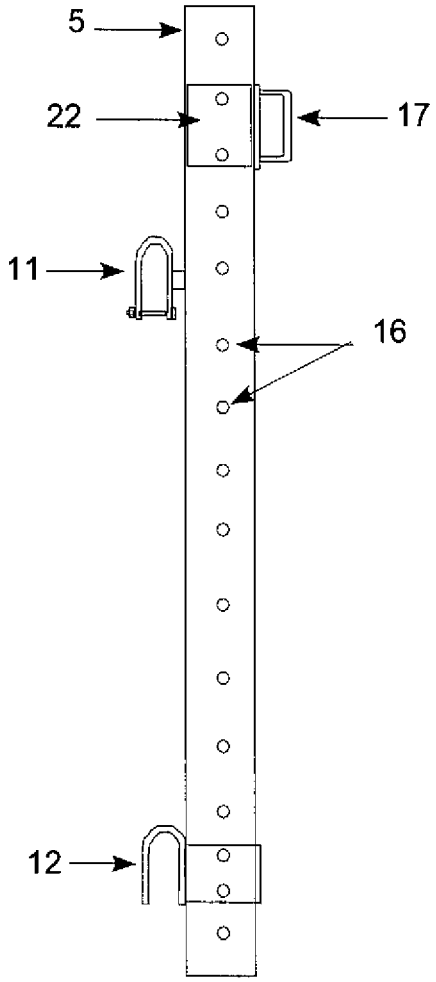
FIG. 6A is an elevational side view of the circular version of a vertical support member.
Figure 6B:
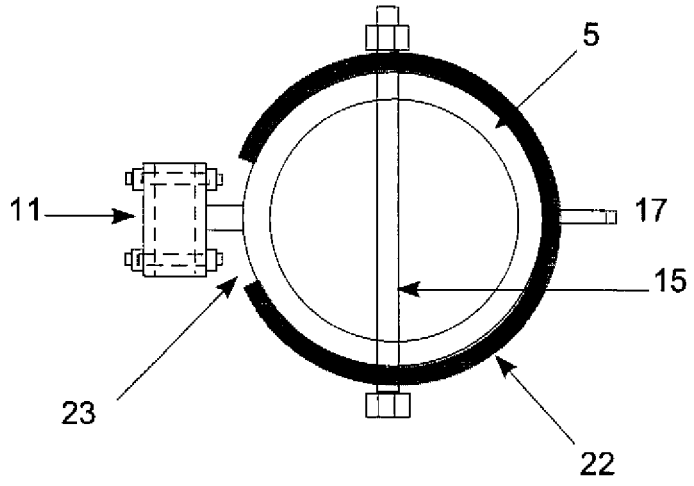
FIG. 6B is a plan view of the top section of the circular version of a vertical support member.
Figure 6C:
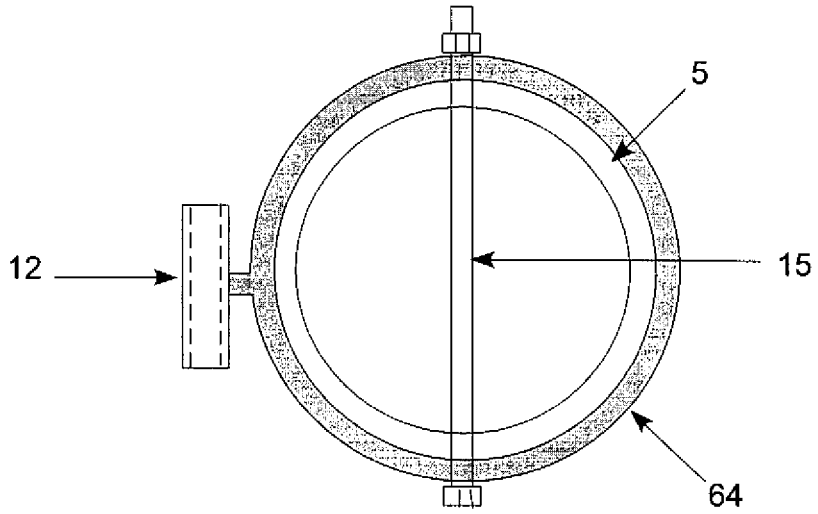
FIG. 6C is a plan view of the bottom section of the circular version of a vertical support member.

FIGS. 6A-C show yet another embodiment of the fall protection system in which the movable attachment means comprises a circular sliding collar 22 with tie off handle 17. The top U-bracket 11 is fixed to the circular vertical support member 5. The circular sliding collar 22 has an opening 23 on its rear side facing the top U-bracket 11 to provide sufficient space between the circular sliding collar 22 and the top U-bracket 11 to enable the collar to pass the top U-bracket 11. The circular sliding collar 22 is movable up and down on the vertical support member 5 using the tie off handle 17. The circular sliding collar 22 is then fixed at a desired elevation with a bolt 15 passing through the holes (not shown) on the collar 22 and the lateral holes 16 of the vertical support member 5. The tie off handle 17 is also used to attach a lifeline (not shown). FIG. 6C is a plan view of the bottom section of an embodiment of the fall protection system using a circular sliding collar 22. The bottom U-bracket is attached to a collar 64. The vertical position of the bottom U-bracket 12 adjustable by sliding the collar 64 along the vertical axis of the vertical support member 5. To secure the bottom U-bracket 12 at a chosen vertical position on the vertical support member 5 the bottom U-bracket 12 a bolt 15 is passed through lateral holes 16.

Figure 7A:
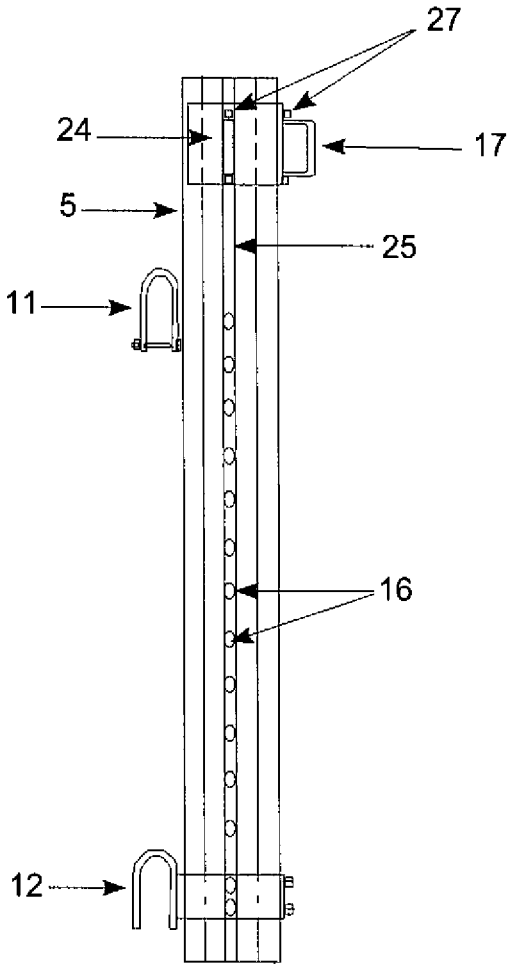
FIG. 7A is an elevational side view of the octagonal version of a vertical support member.
Figure 7B:
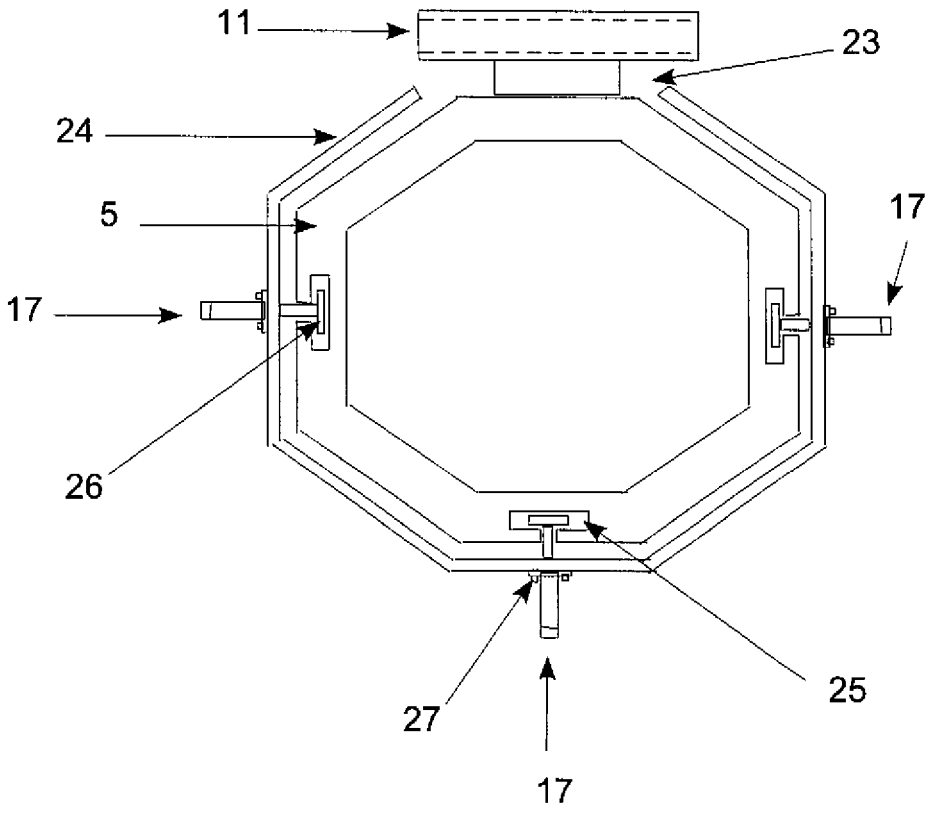
FIG. 7B is a plan view of the octagonal version of a vertical support member.

FIGS. 7A and B show an embodiment of the octagonal version of the fall protection system. In this embodiment the movable attachment means comprises an octagonal sliding collar 24 and one or more tie off handles 17. The octagonal vertical support member 5 has built in T-shaped grooves 25 on its sides. The octagonal sliding collar 24 has T-shaped extensions 26 on its sides extending inward towards the octagonal vertical support member 5. The T-shaped extensions 26 are designed to fit into the T-shaped grooves 25 in the octagonal vertical support member 5. The octagonal sliding collar 24 has an opening 23 on its rear side facing the top U-bracket 11 to provide sufficient space between the octagonal sliding collar 24 and the top U-bracket 11 to enable the collar 24 to pass the top U-bracket 11. The octagonal sliding collar 24 is movable up or down on the vertical support member 5 using either of the tie off handles 17. To fix the octagonal sliding collar 24 at a desired elevation, set screws 27 are used. The vertical position of the bottom U-bracket 12 along the vertical support member 5 is adjustable to accommodate different size scaffold frames. To secure the bottom U-bracket 12 at a chosen vertical position on the vertical support member 5 the bottom U-bracket 12 is bolted in place using to the lateral holes 16.

In the embodiments of the present invention in which movable attachment means are used, the vertical support members or movable attachment means are not limited to those illustrated in the examples above. Any configuration of vertical support members and movable attachment means can be used in these embodiments so long as the vertical support members provide support for a lifeline and the attachment means can be securely yet movably attached to the vertical support members to allow height adjustment of the lifeline.

Figure 11:
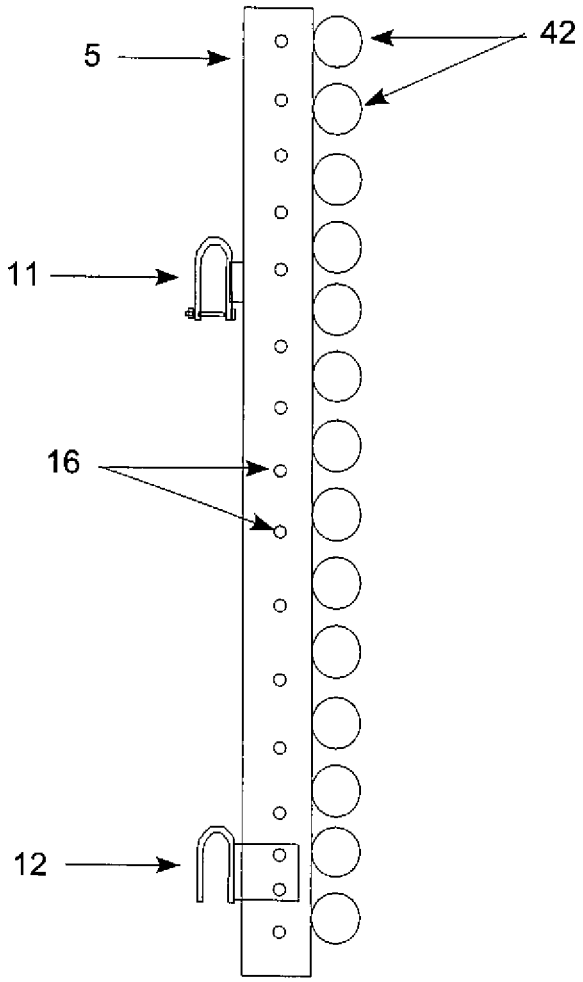
FIG. 11 is an elevational side view of a vertical support member with fixed attachment means.
Figure 12A:
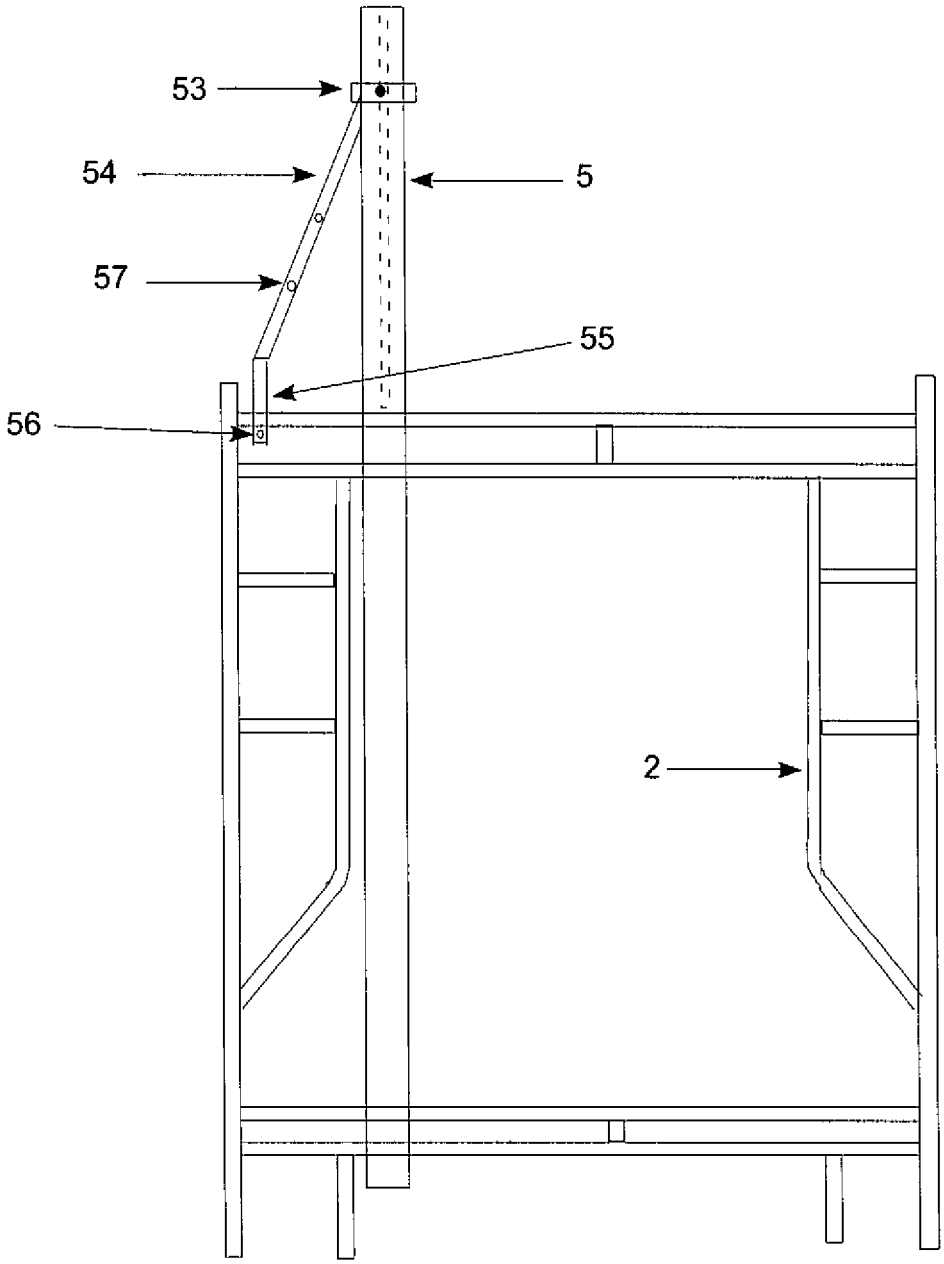
FIG. 12A is a front elevational view of a vertical support member with brace.
Figure 12B:
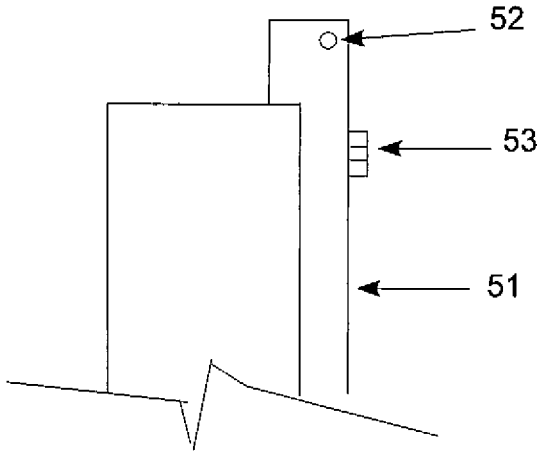
FIG. 12B is a side elevational view of a vertical support member with stiffener plate and brace connection plate.
Figure 12C:
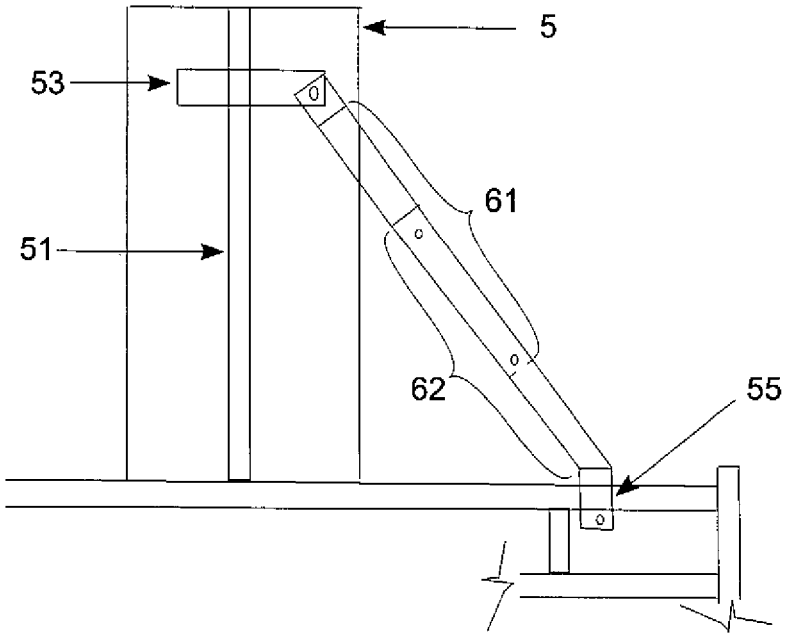
FIG. 12C is a rear elevational view of a vertical support member with stiffener plate, brace and brace connection plate.
Figure 12D:
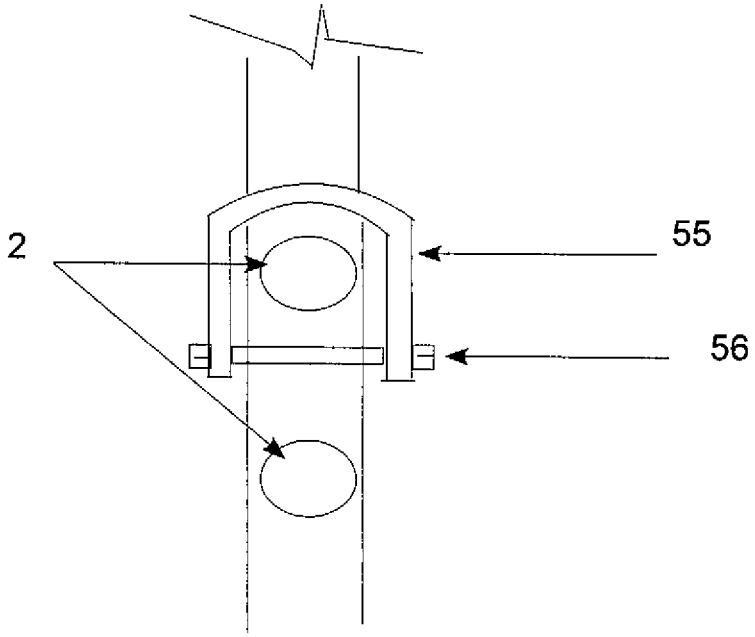
FIG. 12D is a side elevational view of the brace U-bracket shown in FIG. 12C.

The present invention can also be practiced using vertical support members in which the attachment means for the lifeline are fixed structures along the vertical axis of the vertical support members. An embodiment of the invention using fixed attachment means for the lifeline is shown in FIG. 11. The vertical support member 5 has a top U-bracket 11, a bottom U-bracket 12, and attachment loops 42. The attachment loops 42 are used to attach the lifeline (not shown here). Examples of other structures or devices that can be used to attach a lifeline are hooks, rings or any other device or structure known in the art so long as the structure of device can be used to securely attach a lifeline. In the embodiment illustrated in FIG. 11 the height of the lifeline (not shown here) is adjusted by attaching the lifeline to different attachment loops 42 positioned along the vertical axis of the vertical support member 5.

Figure 8A:
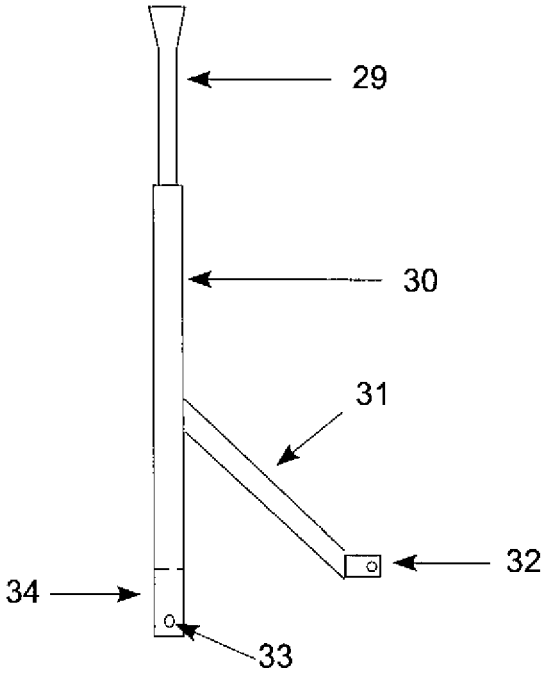
FIG. 8A is an elevational side view of a deflector post.
Figure 8B:
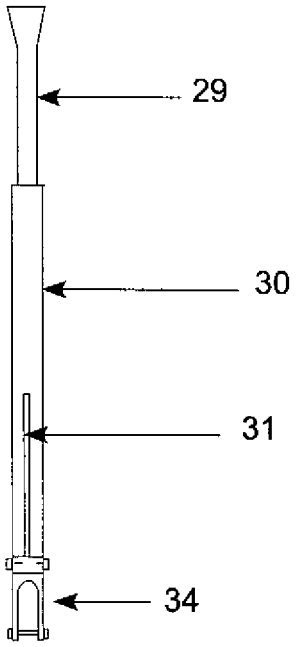
FIG. 8B is an elevation front view of a deflector post.
Figure 8C:
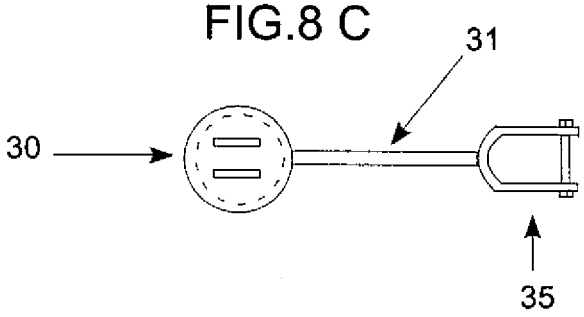
FIG. 8C is a plan view of a deflector post.
Figure 8D:
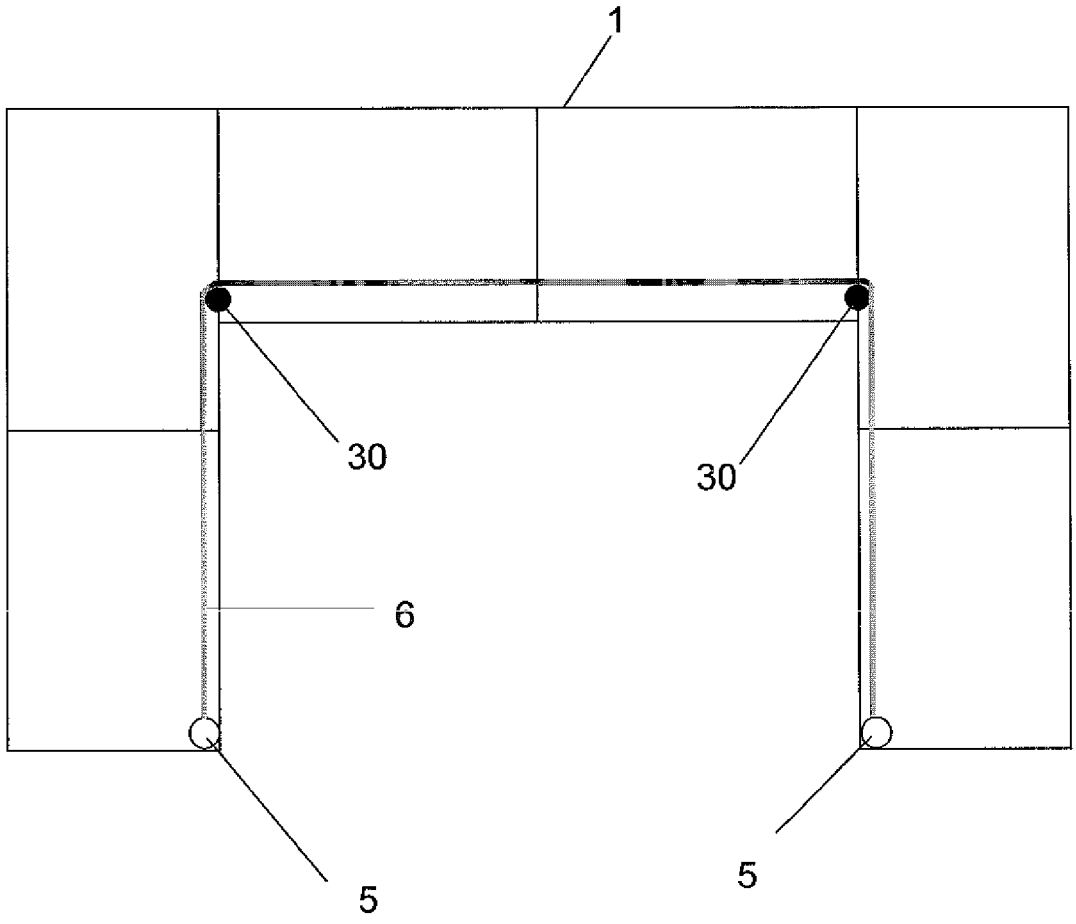
FIG. 8D is a schematic top view of the fall protection system showing the deflector posts in relation to the system.

In a particularly advantageous embodiment the fall protection system uses a deflector post 30 as shown in FIGS. 8A-C to go around turns and corners as shown in FIG. 8D. The deflector post 30 has an upper roller portion for engaging and guiding the horizontal life line. Ideally, the roller 29 is tapered on top to keep the lifeline in place. Preferably, the roller 29 is made out of material that reduces friction. In one particularly preferred embodiment the roller 29 is made out of TEFLON®. On its bottom end the deflector post 30 has a deflector post U-bracket 34 adapted to mount the post on top of a scaffold frame. The deflector post 30 is fixable on the scaffold by using a bolt extending through a lateral hole 33 in the deflector post U-bracket 34. In addition, the deflector post 30 has a brace 31 extending at an angle from approximately the middle portion of the post downwards. The preferred angle between the deflector post and the brace is 45°. At its distal end the brace 31 has a brace U-bracket 35 with a lateral hole 41 that is used to fix the brace 31 to the scaffold frame. Thus, when mounted the deflector post 30 is fixed to at least two points of the scaffold. The U-brackets 34 and 35 are examples to illustrate a convenient way to affix the deflector to the scaffold frame. However, other devices of affixing the deflector can be used to practice the invention. Other examples of devices that can be used to secure the deflector 30 to the scaffold include clamps, clasps, vises, nut & bolt arrangements, fasteners, grips, or quick-release snap clamps. Any attachment can be used so long as the deflector is securely attached to the scaffold.

Figure 9:
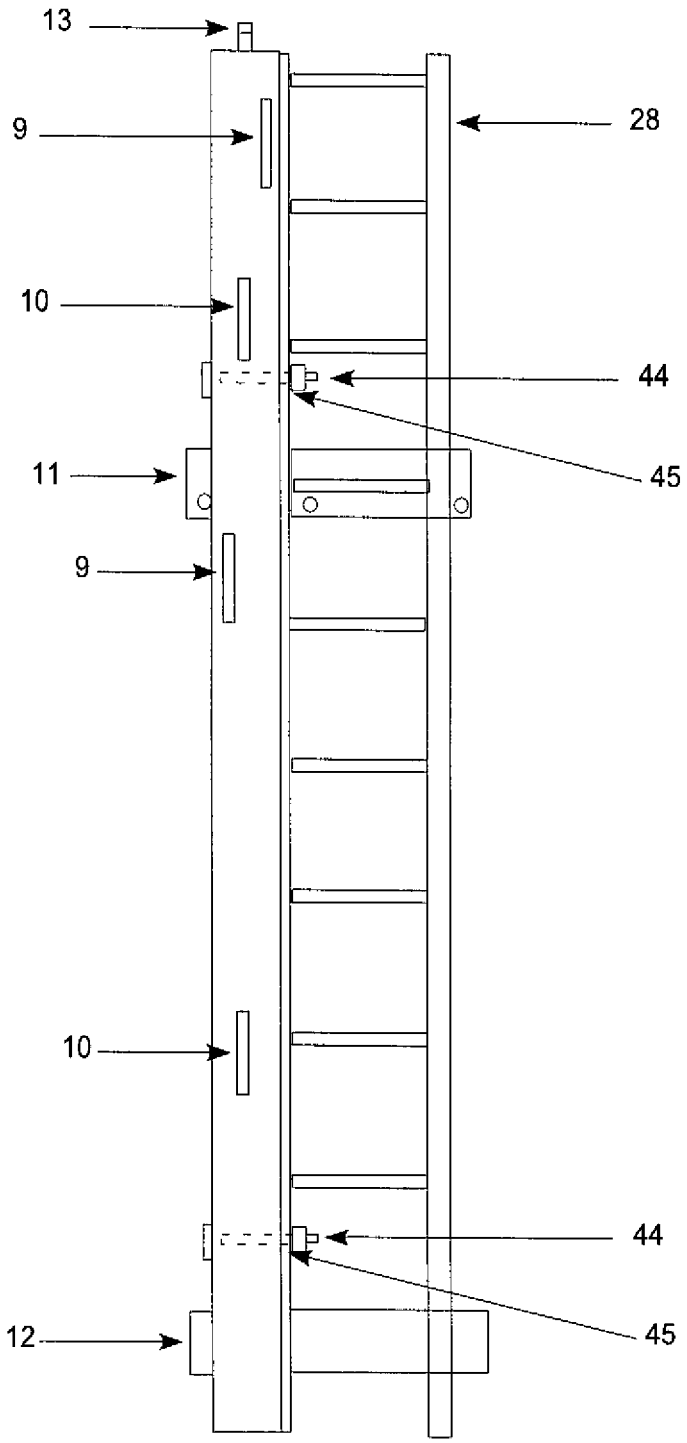
FIG. 9 is an elevational view of the fall protection system with a ladder.

FIG. 9 shows an embodiment of the fall protection system with ladder 28. The ladder 28 is secured to the vertical support member 5 with bolts 44 that extend through lateral holes 45 in the ladder 28 and lateral holes 16 in the vertical support member 5. The vertical support member shown in FIG. 9 has T-plates 9 as movable attachment means. The ladder 28 helps employees to easily gain access to the next scaffold level. While FIG. 9 depicts a particular type of ladder, other ladder types of various designs can be used to practice the invention.

Figure 10A:
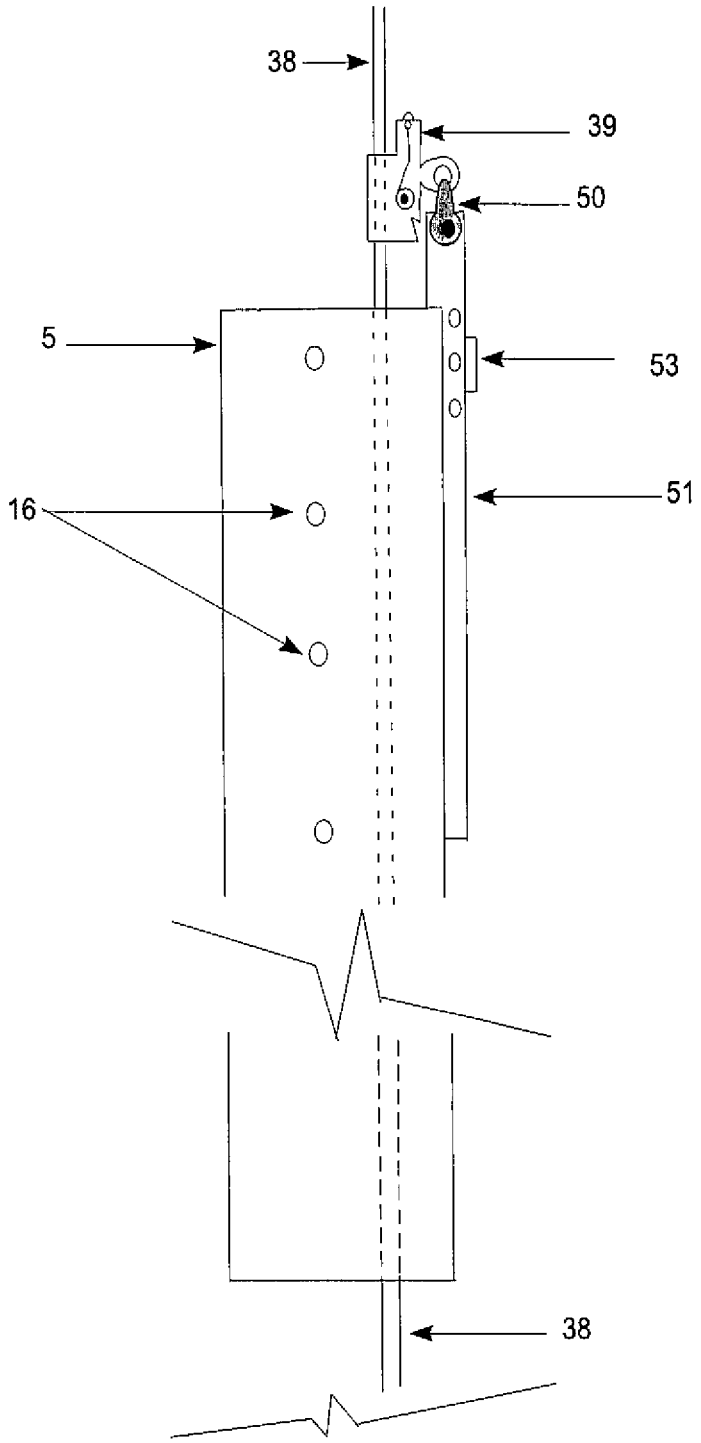
FIG. 10A is an elevational side view of a vertical support member with rope grab mechanism.
Figure 10B:
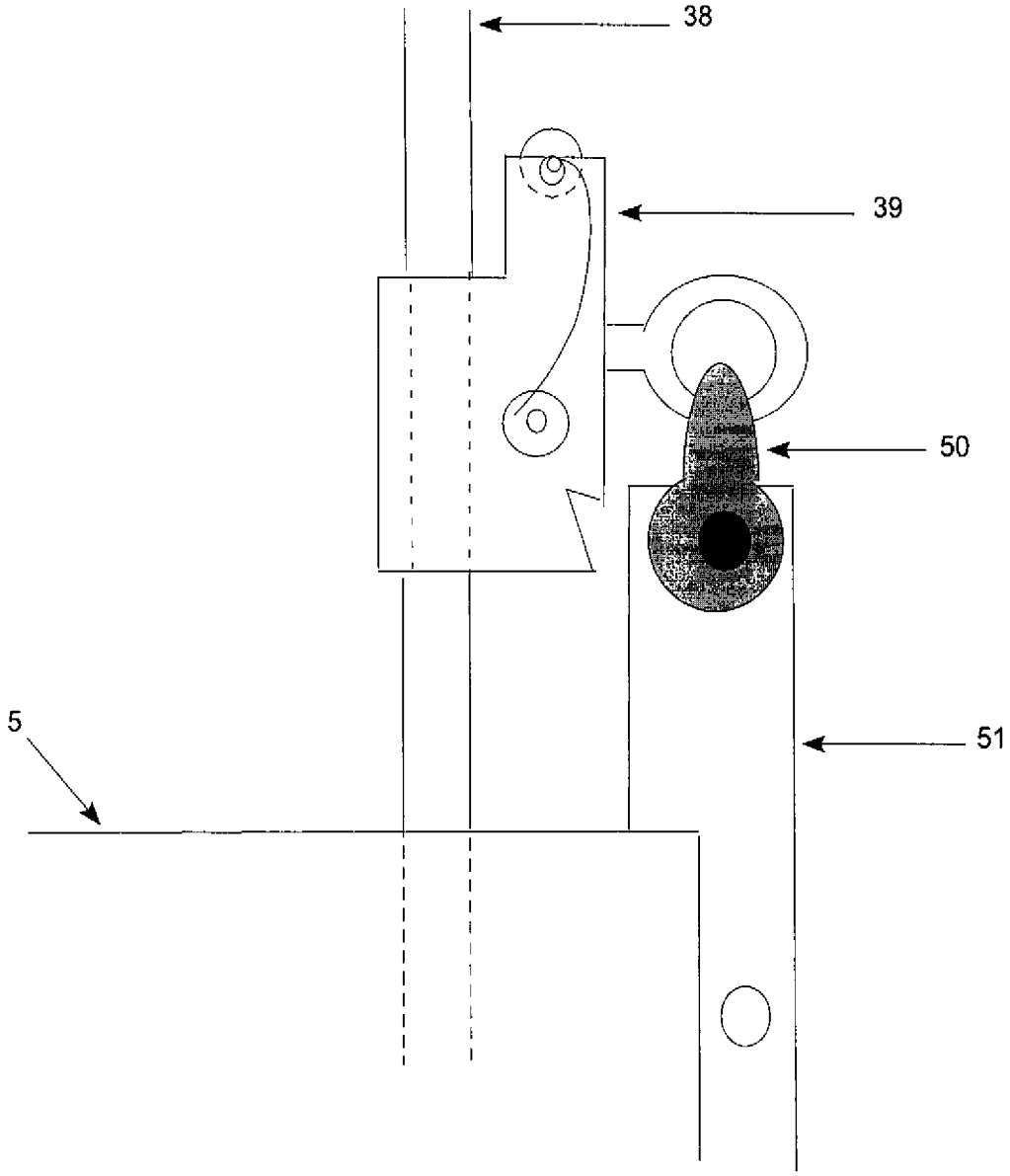
FIG. 10B is a elevational side view of the vertical support member shown in FIG. 10A showing in more detail the connection between the rope grab mechanism and the vertical support member.

FIGS. 10A and 10B show an embodiment of the fall protection system with rope grab device 39 as additional failsafe. A rope grab attachment means 51 is attached to the rear upper portion of the vertical support member 5. The rope grab attachment means 51 extends vertically past the upper end of the vertical support member 5 and has a shackle 50 connected to its upper end. The shackle 50 is connected to the rope grab device 39. Ideally, the rope 38 is secured to the top of a building or structure around which the scaffold is built. The rope 38 runs through the rope grab device 39 and the vertical support member 5. In case the vertical support member 5 becomes detached from the scaffold structure and falls down, the rope grab device 39 tightens and prevents further downward movement of the vertical support member 5. The rope grab mechanism 39 can be attached to the vertical support member 5 using different attachment means. The rope grab mechanism 39 can also be attached directly to the vertical support member 5 for example by welding the rope grab mechanism 39 directly to the top of the vertical support member 5. In fact, any means for attaching a rope grab mechanism 39 to the vertical support member 5 can be used so long as the rope grab mechanism 39 remains firmly attached to the vertical support member 5 in case of a fall and so long as the rope 38 can run through the rope grab mechanism 39 and the vertical support member 5.

Figure 10C:
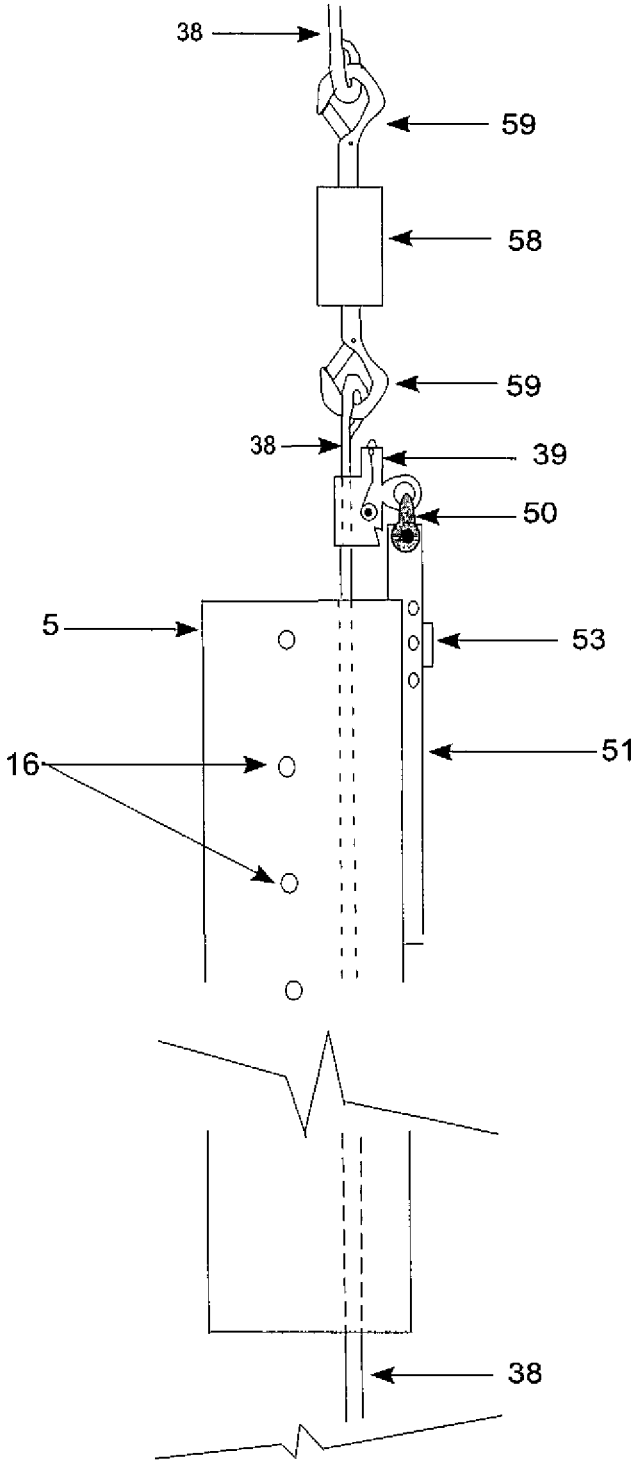
FIG. 10C is an elevational side view of the vertical support member with rope grab mechanism and shock absorber.

FIG. 10C shows an embodiment of the fall protection system with shock absorber 58. The shock absorber 58 engages the safety rope 38 through shock absorber attachment means 59 such that the portion of the safety rope 38 that extends through the vertical support member 5 is suspended from the bottom portion of the shock absorber 58. FIG. 10A also shows brace attachment means 53. The brace attachment means 53 is attached to the upper rear portion of the vertical support member 5 such as to provide sufficient space for the movable attachment means (not shown here) to pass. The shock absorber 58 can be any device known in the art designed to absorb kinetic energy from a falling person, equipment or other object. The shock absorber attachment means 59 can be hooks, cable clamps, carabiners or any device or arrangement so long as the attachment means securely connect the shock absorber 58 to the safety rope 58 to withstand the force exerted on it by a fall and accidental disengagement of the vertical support member 5 from the scaffold structure.

FIG. 12A-D show an embodiment of the fall protection system with adjustable brace 54. To prevent the vertical support member from moving sideways in case of a fall the adjustable brace 54 is secured to the scaffold frame 2 and the vertical support member 5. On its bottom end the adjustable brace 54 is secured to the scaffold frame 2 with U-bracket 55 using a bolt 56. On its top end the adjustable brace 54 is connected to the upper portion of the vertical support member 5 through brace attachment means 53. The brace attachment means 53 is connected to the rope grab attachment means 51 such as to provide sufficient space for the movable attachment means (not shown here) to pass. The adjustable brace 54 comprises an upper section 61 and a lower section 62. Both sections are movable along each others longitudinal axes and can be secured at a desired position by set bolts 57. The brace attachment means 53 can be a metal plate or any structure or device to allow the adjustable brace 54 to be securely attached to the vertical support member 5.

Figure 13:
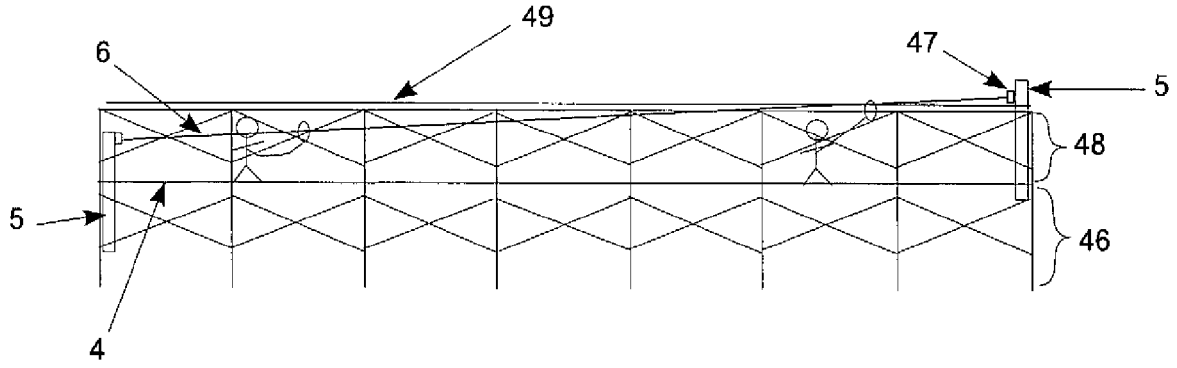
FIG. 13 is a side elevational view of a base level and second level of a scaffold with the fall protection system installed.

Use of the fall protection system during scaffold construction is convenient and straight forward. FIG. 13 illustrates steps how to use the fall protection system during scaffold erection.

First, the scaffold base level 46 is installed on the ground or on an existing scaffold level. A platform 4 is then installed and the erectors will climb to the platform 4. A vertical support member 5 is then installed at each end of the scaffold base level 46. After the vertical support members 5 are installed, a first lifeline 6 is attached to the movable attachment means 47. Scaffold erectors then tie off to the first lifeline 6 and assemble the second level of the scaffold. After the second level 48 of the scaffold is completed, a second lifeline 49 is laid out across the top platform. The scaffold erectors then tie off to the scaffold, move the vertical support members 5 up, affix the vertical support members 5 at the structure of the second scaffold level 48 and climb to the second level 48. The position of the movable attachment means 47 is then adjusted with the top of the scaffold frame of the second level 48. The second lifeline 49 is then attached to the unused movable attachment means 47. Erectors now tie off to the second lifeline 49 and start erecting the next scaffold level. The first lifeline 6 is used to lie across the next platform.

While the invention has been illustrated and described as embodied in a scaffold fall protection system, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

1. A fall protection system comprising:

a first substantially straight vertical support and a second substantially straight vertical support, adapted to be affixed to a scaffold frame;

first and second attachment means provided on the first and second supports, said first attachment means being constructed for releasable attachment of the first and second vertical supports to the scaffold frame, said second attachment means being constructed for movable attachment at a plurality of positions along a vertical axis of said first and second supports; and a lifeline extending between said first and second vertical supports and being attached to the second attachment means, wherein said vertical supports, and said attachment means have an octagonal cross sectional profile, and wherein the attachment means are affixed to said lifeline, and further comprising grooves extending vertically along at least three sides of said vertical supports, said attachment means having extensions on at least three sides on the inside of said cross sectional profile, said extensions being configured to match the profile of said grooves, and wherein the attachment means are affixed to said lifeline.

2. The system according to claim 1 further comprising a ladder adapted to be removably affixed to said vertical supports.

3. The system according to claim 1, further comprising a deflector adapted to be affixed to the scaffold frame for guiding the life line around a corner, said deflector comprising a vertical member having a tapered upper portion for engagement with the life line, and a lateral member, said lateral member extending from said vertical member at an angle of approximately 45°.

4. The system according to claim 1, further comprising a rope grab mechanism attached to said vertical support members.

5. The system according to claim 1, wherein a position of at least one of the first attachment means is adjustable along each of the vertical axis of the first and second member.

6. The system according to claim 5, wherein a one of the first attachment means is constructed as a U-shaped bracket having a downward facing opening for receiving and engaging with a horizontal member of the scaffold frame.

7. A fall protection system comprising:

a first substantially straight vertical support and a second substantially straight vertical support, adapted to be affixed to a scaffold frame;

first and second attachment means provided on the first and second supports, said first attachment means being constructed for releasable attachment of the first and second vertical supports to the scaffold frame, said second attachment means being constructed for movable attachment at a plurality of positions along a vertical axis of said first and second supports; and a lifeline extending between said first and second vertical supports and being attached to the second attachment means, wherein each of the vertical support is provided with grooves extending along the vertical axis of each said vertical support and wherein said attachment means are constructed as a T-plate or sliding collar for movable attachment in the grooves, and further comprising a deflector affixed to the scaffold frame for guiding the life line around a corner, wherein said deflector comprises a vertical portion, said vertical portion having a tapered upper portion for engagement with the life line, and a lateral member, said lateral member extending from said vertical member at an angle of approximately 45°.

8. The system according to claim 7, wherein said vertical supports and said attachment means have a circular cross sectional profile, said attachment means circumferentially surround said vertical supports to at least 50 percent of the circumference of said vertical supports, and wherein said attachment means are affixed to said lifeline.

9. The system according to claim 7, wherein said vertical supports and said attachment means have a square cross sectional profile, and wherein said attachment means are affixed to said lifeline.

10. The system according to claim 7, wherein said vertical supports, and said attachment means have an octagonal cross sectional profile, and wherein the attachment means are affixed to said lifeline.

11. The system according to claim 7 wherein said upper portion of said deflector is made from TEFLON®.

12. The system according to claim 7, further comprising a rope grab mechanism attached to said vertical supports.

* * * * *